US006070273A

United States Patent [19]

Sgro

[11] Patent Number: 6,070,273

[45] Date of Patent: Jun. 6, 2000

[54] BODY PADS PARTICULARY FOR SPORTS

[76] Inventor: Joseph Sgro, 53 Deevale Road, Downsview, Ontario, Canada, M3M 1Z4

[21] Appl. No.: 09/048,798

[22] Filed: Mar. 27, 1998

[51] Int. Cl.[7] ..... A41D 13/00

[52] U.S. Cl. ..... 2/455; 2/464; 2/466; 2/401; 2/231; 2/267

[58] Field of Search ..... 2/455, 456, 460, 2/463, 464, 465, 466, 467, 24, 92, 267, 268, 908, 911, 2, 22, 16; 442/135, 134; 428/213, 911

[56] References Cited

U.S. PATENT DOCUMENTS 4,486,901 12/1984 Donzis ..... 2/2
5,675,844 10/1997 Guyton et al. ..... 2/455
5,689,836 11/1997 Fee et al. ..... 2/465
5,819,312 10/1998 Snyder et al. ..... 2/16
5,851,932 12/1998 Dickson et al. ..... 442/135

*Primary Examiner*—John J. Calvert
*Assistant Examiner*—Robert H. Muromoto, Jr.

[57] ABSTRACT

A body pad construction for a padding garment, having a body shape moulded pad formed of expanded polypropylene foam material, of a predetermined density, and moulded and shaped to conform to a portion of the body to be protected, a laminate reinforcement of scrim filaments bonded with the exterior of the moulded body pad, and shaped to the exterior of the body pad, inner and outer covering panels formed of a laminate of synthetic woven fabric the inner and outer panels being placed on opposite sides of the pad, and the fabric being bonded to the pad on both sides, and the layers of the inner and outer panels being bonded together, around the edges of the pad.

15 Claims, 9 Drawing Sheets

BODY PADS PARTICULARY FOR SPORTS

FIELD OF THE INVENTION

The invention relates to protective body padding and in particular to such protective body padding as is used in sports and athletics.

BACKGROUND OF THE INVENTION

Protective body padding for use in athletics must meet a number of exacting requirements.

In the first place, it must be effective for the purpose intended and provide adequate protection for the type of impact expected from a particular sport or athletic activity. These impacts may vary from one sport to another, and are particularly extreme in the sport of hockey, where the hockey puck may be travelling at high speed when it hits the body of a player.

The body padding must also be light in weight, so that it does not interfere with the athletic ability of the player. The padding must also be as far as possible, of reasonable cost so that it is affordable and usable by all players, regardless of their financial position. It should be easily and securely attached to the body. It should be reusable many times over and capable of withstanding numerous high speed impacts without breaking down and loosing its padding effectiveness.

All of these requirements are fairly self-evident and are set out here merely as a background for the appreciation of the body padding according to the invention.

In the past, body padding has usually been made up of some kind of padding material which might in some cases simply be cotton batten, or hemp fibres, or other common natural padding materials. These materials would simply be stuffed into cavities in padding garments such as leg pads, waist pads, shoulder pads and the like. The pads themselves in the past have typically been made of cotton or other fabric materials, and in some cases leather has been used. However this increases the cost and weight of the padding, and also adds to the bulk without providing much additional protection.

More recently synthetic materials have been used. Nylon fabric materials have been used as the basis for constructing the padding garments, and synthetic plastic materials such as foam materials have been used in some case, enclosed within such nylon fabric garments. However, all of these prior padding systems have usually involved sewing as a means of fastening the outer materials together, and the padding has been to a considerable extent, liable to damage, such as cracking a folding and developing lines of weakness, if it is flexed around the body during use .

In some cases in an effort to overcome these cracking and folding problems, foam padding materials were used which were of two or three part laminate construction. Pads were cut out from sheets of foam material such as polyester or polyethylene or polyurethane foam, for example. Then, in order to hold these foam pads together, they would be laminated with injection molded or thermoformed shell like member of various shapes of harder plastic such as a polyethylene. The fabrication of these pads was labour intensive. The fabrication of the injection moulded shaped shells was costly, and the end result was relatively heavy and not a totally effective form of padding. Especially, the use of hard shells formed of injection moulded plastic was liable to suffer damage as a result of heavy impacts of small objects such as a hockey puck. Once the outer shell was broken, the padding efficiency of the garment was drastically reduced and it would have to be either repaired by replacing the padding or simply replaced altogether. Furthermore the use of rigid shells imposed restrictions on the design of the padding. Clearly if the shell was too extensive it would substantially interfere with the mobility of the wearer. Consequently there had restrictions placed on the size and extent of the hard shell. This could in some cases leave parts of the body unprotected In order to make these systems effective, it was necessary for manufacturers to resort to more and more expensive materials and more and more expensive manufacturing techniques, so that the cost of such pads became a very significant factor in the cost of participation in a sport or athletic activity, and the bulk and weight was inconvenient.

BRIEF SUMMARY OF THE INVENTION

With a view to satisfying at least some of the foregoing requirements, the invention comprises a body pad construction, in turn comprising, a body shape moulded pad formed of expanded polypropylene foam material, of a predetermined density, and shaped and moulded so as to conform to a portion of the body to be protected, a laminate reinforcement comprising reinforcing scrim filaments , bonded with the exterior of said moulded body pads, and shaped to the exterior of said body pad in the moulding process, inner and outer covering panels formed of of synthetic woven fabric to which may be laminated a thin layer of flexible polyurethane foam material, and said inner and outer panels being placed on opposite sides of said padding, and adhesive means bonding said synthetic woven materials with or without a flexible thin polyurethane foam layer to said padding on both sides, and further adhesive means bonding said inner and outer panels together, around the edges of said padding, whereby to provide a marginal portion there around, for construction into a complete body pad system, and body attachment means secured to said marginal portions.

The invention further envisages the use of body pads comprising laminate layers of a first inner light weight low density polypropylene foam, and at least one or more outer higher density harder layers of polypropylene foam bonded to said inner layer thereby providing for a multiple layer of impact absorption material of varying densities.

The moulding of polypropylene expanded foam products is a relatively simple and well-known technique and can be carried out in low cost moulds, and requires little application of pressure, the pressure usually being generated internally by the injection of steam into the polypropylene beads within a mould. This manufacturing technique is high speed and low cost and produces effective light-weight body pads for use in accordance with the invention.

Preferably the body pads formed in accordance with the invention are flexible so that they will readily conform to the body as the padding garment is put on and tightened up on the body, and will be of relatively light weight, so that the wearer will experience the least possible interference with his athletic abilities.

Another advantage flowing from the use of these low cost moulding techniques, is that body pads are produced which are the optimum size, shape and thickness and contour desired for the particular application and part of the body, and there is a minimum of material waste, which compares favourably with earlier systems in which pads were cut from panels of material, leaving large amounts of waste.

The fibre glass scrim webbing described here by way of example only and without limitation may be used for reinforcement. One form of such scrim material is a well known product in which strands of fibre glass are interwoven at right angles, so as to provide an open mesh web material having great strength in all directions, and being highly flexible. Other suitable scrim materials are described below.

The provision of pads of polypropylene bonded with fabric, is found to provided both flexibility and strength to the polypropylene padding, so that the pad has the ability to conform to the body and to flex during use without loss of its ability to absorb and withstand impacts which would otherwise injure the body.

For maximum impact resistance there will be several, ie three layers of expanded polypropylene foam materials of varying densities, with the softest usually closest to the body, and enclosed in laminated layers of synthetic fabrics and polyurethane foam sandwiched on both sides, and the polypropylene foam being laminated on one or on both sides with reinforcing scrim or other suitable material material.

The reinforcing scrim layers may be formed of for example fibre glass strands, aramid fibres, polyester fibres, polyethylene fibres, carbon fibres, or even flexible metallic fibres, to name only a few suitable scrim reinforcement materials, and unidirectional materials may also be used in some cases.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN BRIEF DESCRIPTION OF DRAWINGS

FIG. 1 is a perspective of a typical padded body garment, in this case a pair of padded pants, such as are used in hockey with movement being shown in phantom;

FIGS. 2 and 2*a* show a section of one pant leg along the line 2—2 of FIG. 1 showing two positions;

DESCRIPTION OF A SPECIFIC EMBODIMENT

Figure 1:
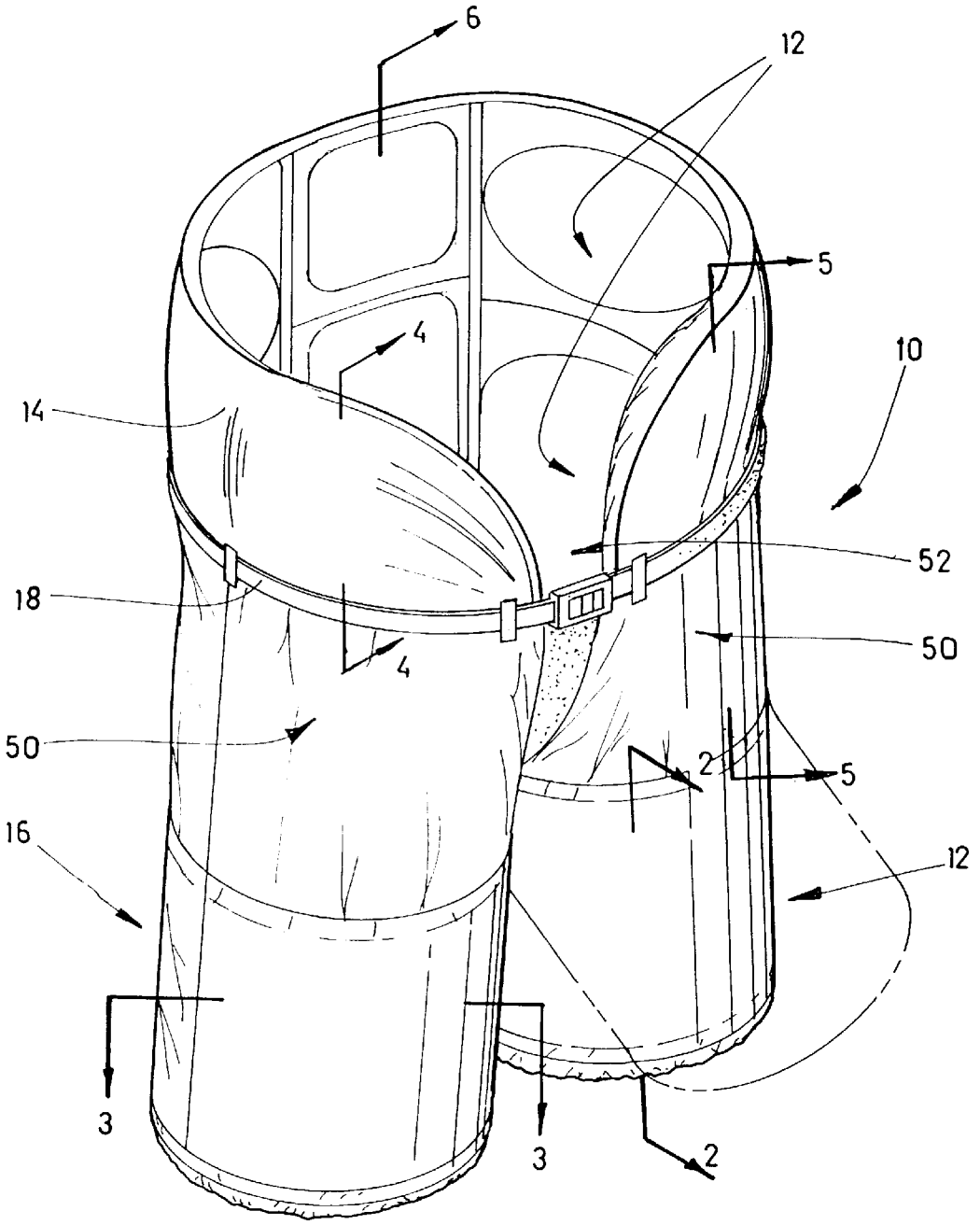

Referring first to FIG. 1, it will be seen that this illustrates a pair of padded pants indicated generally as 10, with may be used for various athletics where the body must be protected from heavy or high speed impacts, either from other players, implements such as sticks, or playing objects, such as a ball, puck or the like, or from collisions with fixed objects such as goal posts, boundary walls or the like.

In this particular case the pants 10 are designed for use in the game of hockey, but this is merely by way of illustrating the invention and is without limitation. The invention has application to any type of padded body protection, whether worn as a garment, or worn simply as a shield for part of the body. For example even in the sport of fencing a shield may be worn in front of the chest, which is not in the true sense a garment. Accordingly when reference is made herein to a padded athletic garment it will be understood that the word garment is to be understood broadly as any form of padding that may be attached to protect any part of the body, whether it is actually worn as a garment in the narrow sense of the word, or is simply attached to a part of the body.

The pant 10 will be seen generally to be provided with various padded portions indicated as 12, and has a trunk 14 and legs 16, and a belt 18, which may be tightened up to secure the pants on the body. The legs 16 are formed loosely so that they can swing, as shown in phantom, to allow athletic movement during play. The design of the pants 10 is thus intended to impose a minimum of restriction on movement of the body, and as will appear below is of minimum weight so as to avoid imposing excessive loads on the athlete, which would impede playing of the game.

The exterior of the pants is comprised of an outer flexible cloth layer 20, typically being a strong material woven of polyester fibres or the like. The outer layer may be made in various colours to suit the requirements of a particular team, for example. Within the outer layer 20 the pants are provided with a plurality of pads 12, as already indicated.

Figure 2:
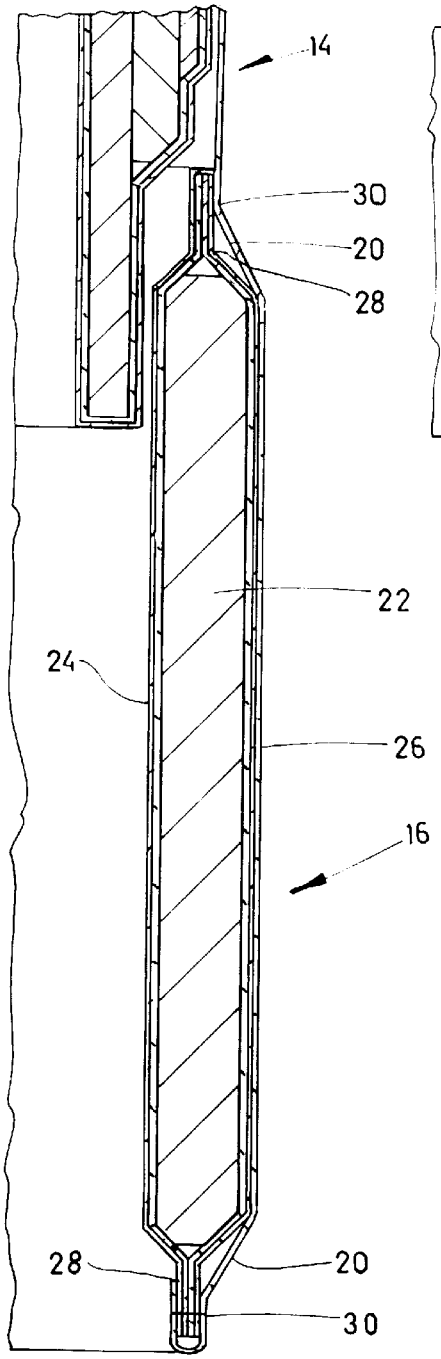
Figure 2A:
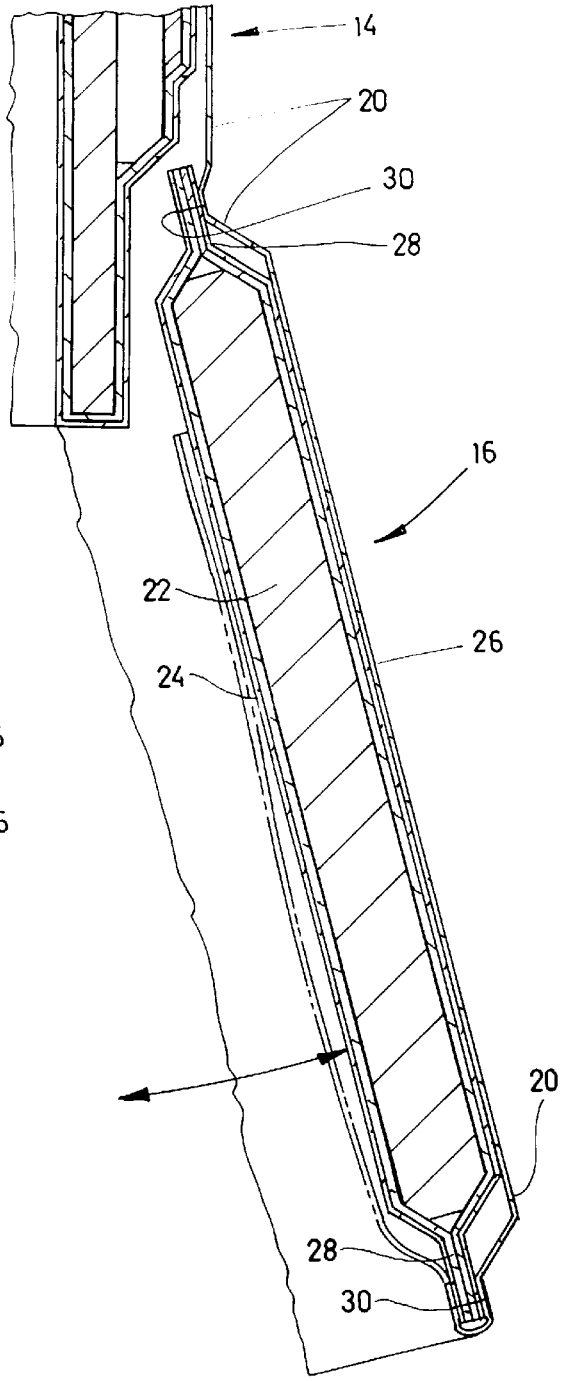
Figure 3:
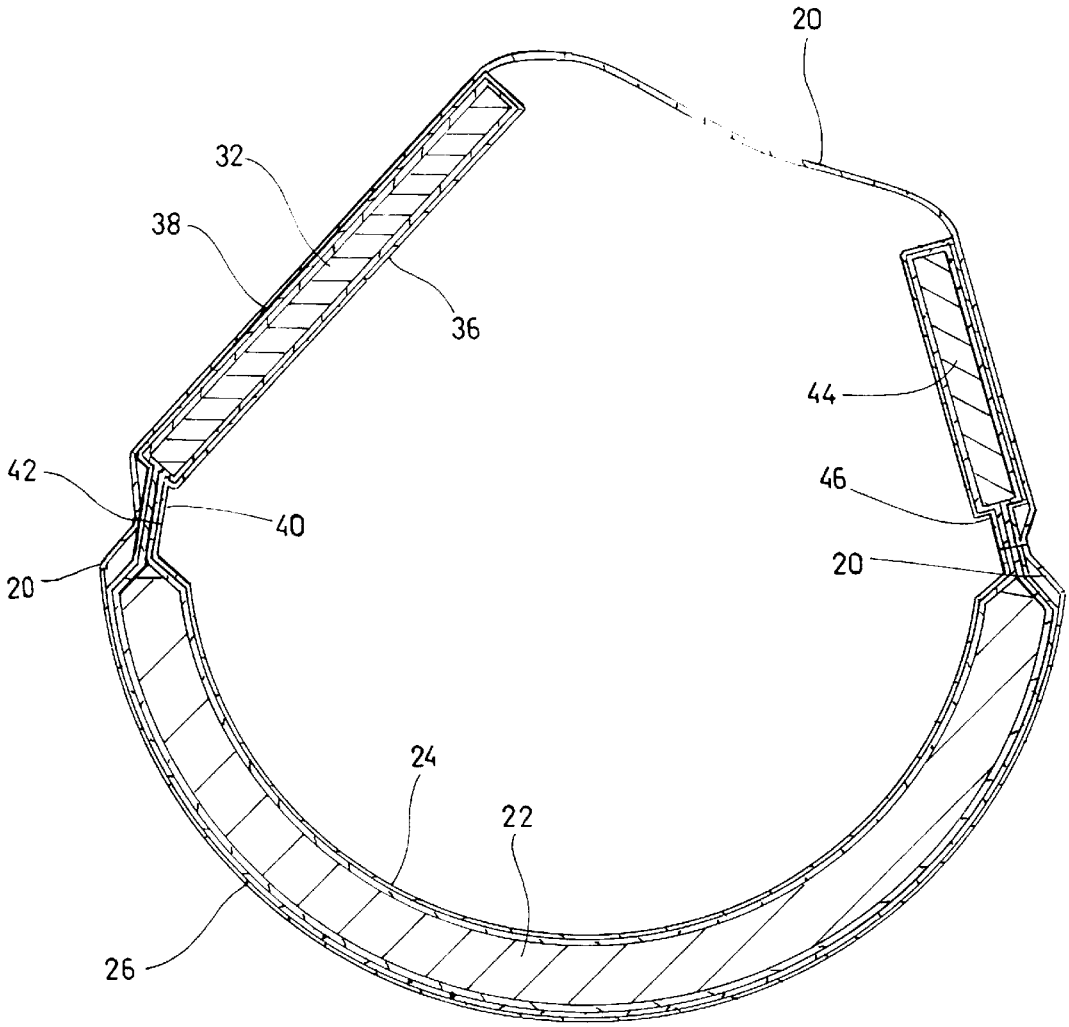
FIG. 3 is a section of one pant leg along the line 3—3 of FIG. 1.

FIG. 2 illustrates the legs 16 of the pants, and the pads 12 in this region will be seen to comprise a central front pad portion 22 of polypropylene foam material, enclosed within a closure sleeve comprising an inner composite panel 24 and an outer composite panel 26. Panels 24 and 26 are bonded adhesively to the pad 22 and are adhesively bonded together around the edges of pad 22 to form edge strips 28. The edge strips 28 at the upper and lower edges of pad 22 are secured to the inside of outer layer 20, in this case by simply sewing as at 30—30. The pads 22 are thus free to swing as the wearer moves his legs during play. The pads 22 are moulded into a generally curved shape in section, FIG. 3, so that they generally conform to the shape of the legs themselves. This is achieved during manufacture as will be described below.

The legs 16 also have a further rear pad 32, on each leg. The rear pads are fabricated in the same way as the front pads 22, and comprise a pad portion 34 of polypropylene foam material, which may be formed flat, or may be molded into a curved shape (not shown) as desired. Pad portion 34 is enclosed in inner and outer closure panels 36–38, which are adhesively bonded to pad portion 34. Edge strips 40—40 are formed around the edges of pad portion 34 by adhesively bonding edge portions of inner and outer panels 36–38 to one another. Rear pads 32 are secured to the inside of outer layer 20 by lines 42 of sewing, so that pads 32 can swing freely without interfering with leg movement.

Legs 16 also have intermediate pads 44 formed and enclosed in the same way as pads 32, and secured to the inside of outer layer 20 by lines of sewing, around edge strips 46. In this way the legs of the wearer are substantially protected from blows and impacts around the major portion of their circumference, and the legs are free to move during play without impediment from the protection.

Legs 16 also have a flexible outer layer portion 46, which extends between rear pad 32 and intermediate pad 44. This area is unpadded since it is deemed unlikely that blows or impacts are going to be received there. It is important to observe that the front pads 22, rear pads 32 and intermediate pads 44 and joined together by sewing of their respective edge strips 28–40 and 28–46.

These edge strips are overlapped where they are sewn so that they form narrow areas having a thickness equal to two inner panels and two outer panels, making four in all.

These narrow overlapped areas thus provided for great flexibility between the panels, and at the same time provide a degree of protection, along the narrow overlapped areas.

Note also that the outer layer 20 is also sewn to these narrow overlapped areas so as to function to hold the respective pads in place with greater security.

Upwardly of the legs is the trunk portion 14 of the pants 10. The provision of padding in the trunk area requires some different considerations than in the legs themselves. Some greater degree of flexibility of mounting of the padding is deemed necessary in the trunk so that it is possible for wearer to move freely and yet be adequately protected in the most vital areas. For this reason the trunk padding is in general to be found attached mainly to the upper edge of the trunk outer layer 20, and hangs more or less freely in most cases down inside the outer layer, and where possible overlaps the padding in the legs. This will now be described in more detail.

Trunk front pads 50—50 are mounted on either side of the pant fly opening 52.

Figure 5A:
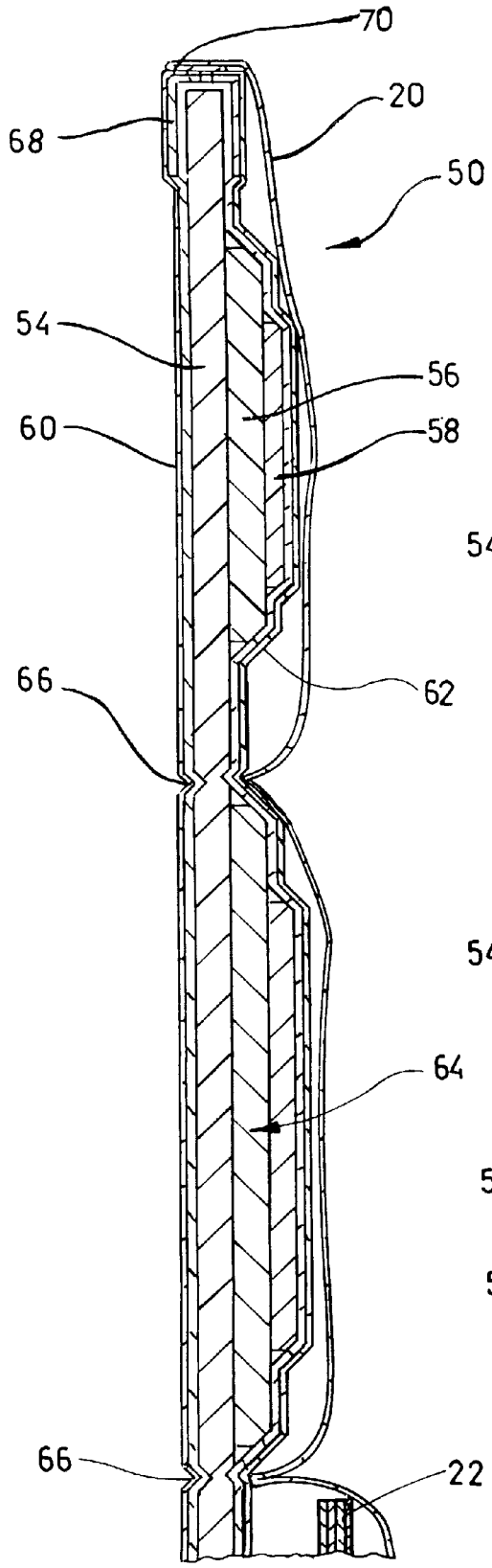
FIG. 5A is a section along a trunk portion of the pants along line 5—5 of FIG. 1.
Figure 5B:
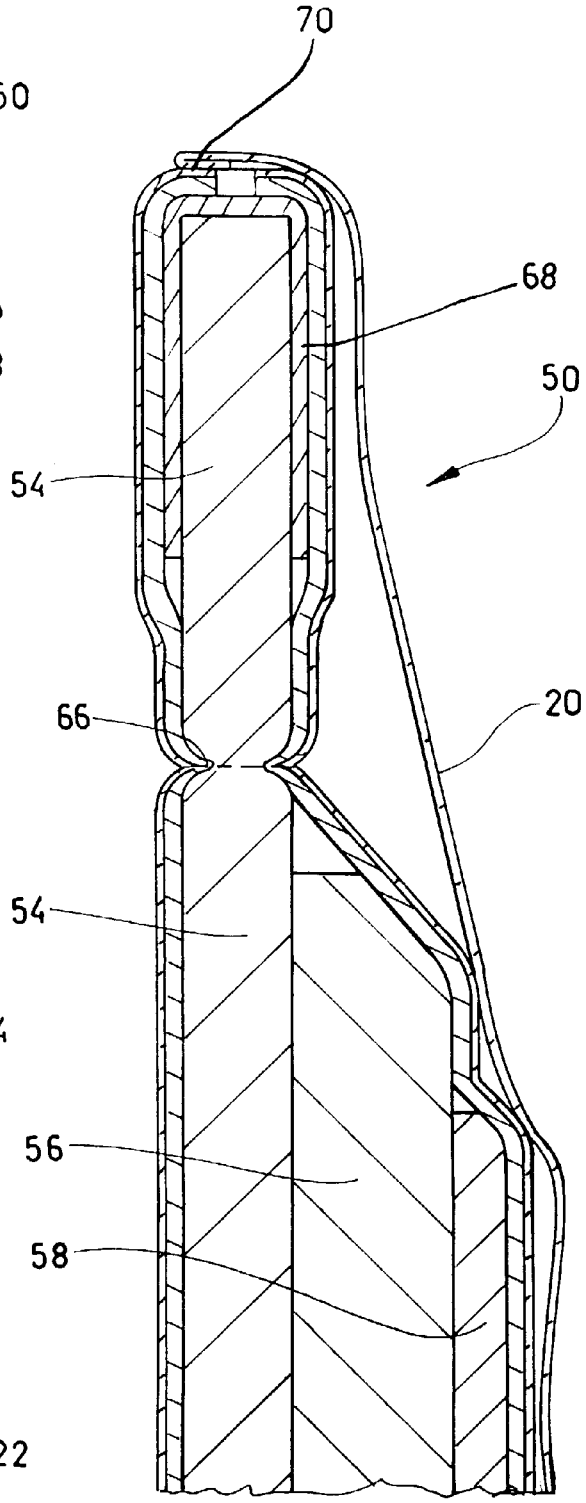
FIG. 5B is a section corresponding to FIG. 5A greatly enlarged.

They comprise a first inner pad portion 54 of softer polypropylene having a predetermined first density. Inner pad portion 54 extends from top to bottom of the trunk area (FIG. 5A) and being softer it can conform more readily to the shape of the body, and in particular provides a region of padding around the upper waist area which permits athletic movements while the padding in this region can flex and bend without interfering with such movements. In order to increase the degree of body protection, additional pad layers 56 and 58 are laminated over intermediate areas of pad 54, at spaced apart locations. The additional pad layers are of higher density polypropylene foam material which is both stiffer than pad 54, and has a higher impact resistance than pad 54, and thus establishes zones or areas of high impact resistance, surrounded by regions of progressively lesser impact resistance, but having progressively greater flexibility. The entire composite pad comprising inner pad 54 and the harder pad layers 56–58 is enclosed in closure inner and outer panels 60–62 which as before are adhesively bonded to the pads. The harder pad layers 56–58 are seen to be of progressively decreasing area. This arrangement of multiple layers of pads of decreasing area, is repeated again at 64 so as to create multiple areas of maximum impact resistance, at spaced intervals. Between these areas the inner pad portion 54 extends to provide some protection, and at the same time to allow greater flexibility between the thicker harder areas.

The inner and outer closure panels are sewn to the inner pad portion 54 along lines of sewing 66. At its lower end flexible pad portion 54 extends downwardly into inwardly overlapping relation with front leg pads 22, but without any attachment thereto. In this way swinging of the legs is not impeded by any connection between the leg pad and the trunk padding. In order to increase comfort around the waist areas a layer 68 of flexible polyurethane foam is bonded to the upper region of flexible pad 54 extending over both inner and outer sides of pad 54 and folding over its top edge. The outer layer 20 is secured by sewing at 70 to the edges of inner and outer closure panels 60–62.

Figure 4:
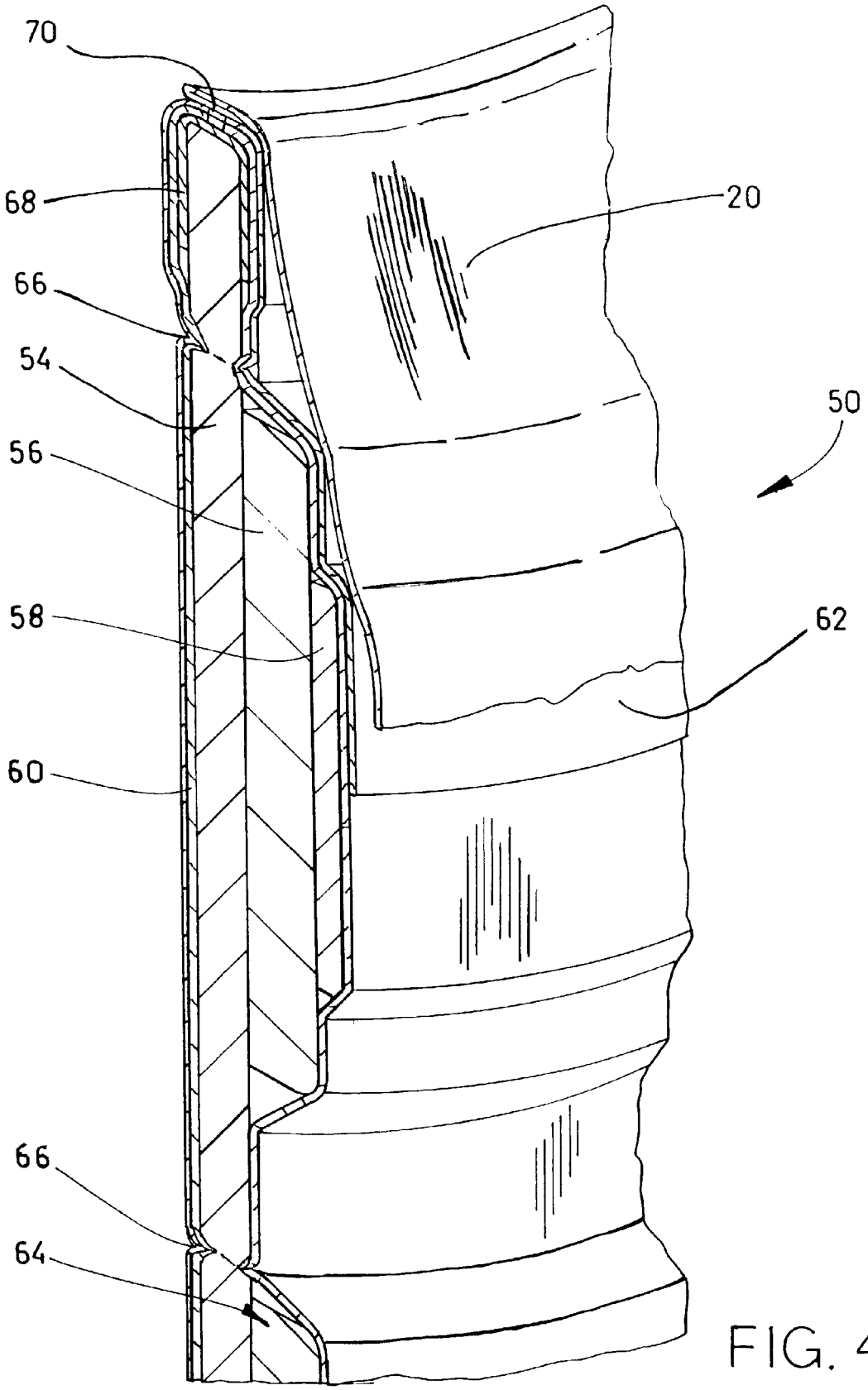
FIG. 4 shows a section of the trunk portion of the pants, along the line 4—4 of FIG. 1.

The entire combination of the inner pad 54 and pad layers 56–58 and 60 are thus suspended from the top edge of the trunk portion of the pants. FIG. 4 further illustrates the construction of the front padding of the trunk.

Figure 6:
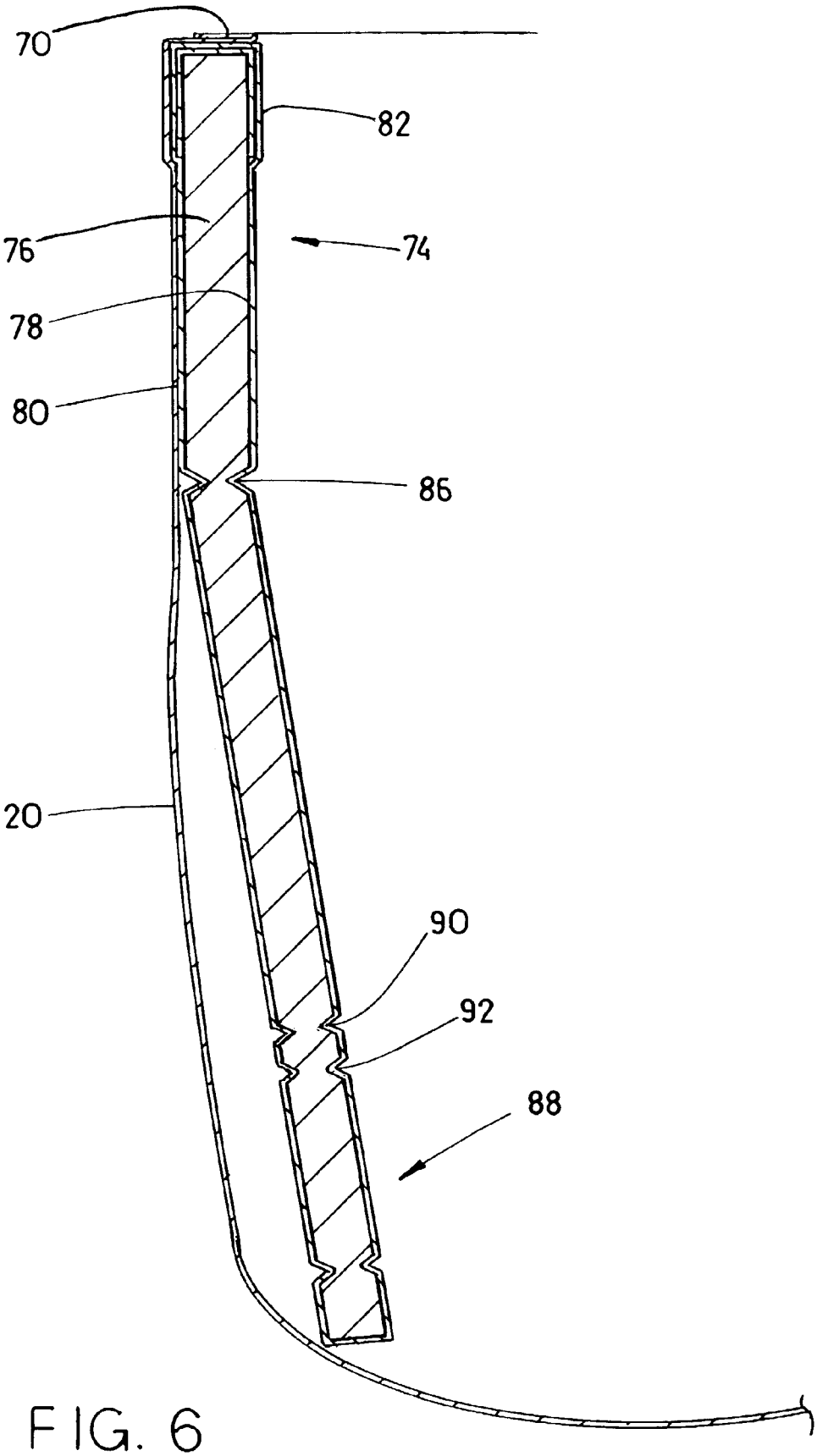
FIG. 6 is a section of the seat and rear trunk of the pants along line 6—6 of FIG. 1.

FIG. 6 illustrates the padding at the rear of the garment. The outer layer 20 is shown extending from the waist area of sewing at 70 downwardly and curving forwardly under the seat or buttocks of the wearer. Rear upper pad 74 is suspended from waist sewing 70 and consists of a core or inner pad 76 of expanded polypropylene material, preferably shaped or molded to fit the curvature of the body. Inner and outer panels 78 and 80 are bonded around the exterior of pad 76. Panels 78, 80 may simply be synthetic woven fabric panels, or may comprise laminates of fabric and polyurethane foam as described above. Preferably an extra waist area padding layer 82 is folded over both sides of pad 76 around its per edge to soften the waist area.

An intermediate pad 84 is connected to pad 74, by a line of sewing 86. This renders intermediate pad more flexible and enables it to fold around the curve of the buttocks.

Pad 84 is made in the same way as pad 74, except that there is no upper waist layer 82.

A lower pad 88 is connected to intermediate pad 84 by two lines of sewing 90 and 92. This provides a more readily flexible join in this area and enables lower pad to fit around the lower curve of the buttocks without obstructing movement. Pad 88 is formed in the same way as pads 74 and 84.

Preferably an extra line of sewing 94 is formed along the lower region of pad 88 to still further increase the flexibility in this region.

Figures 7, 8:
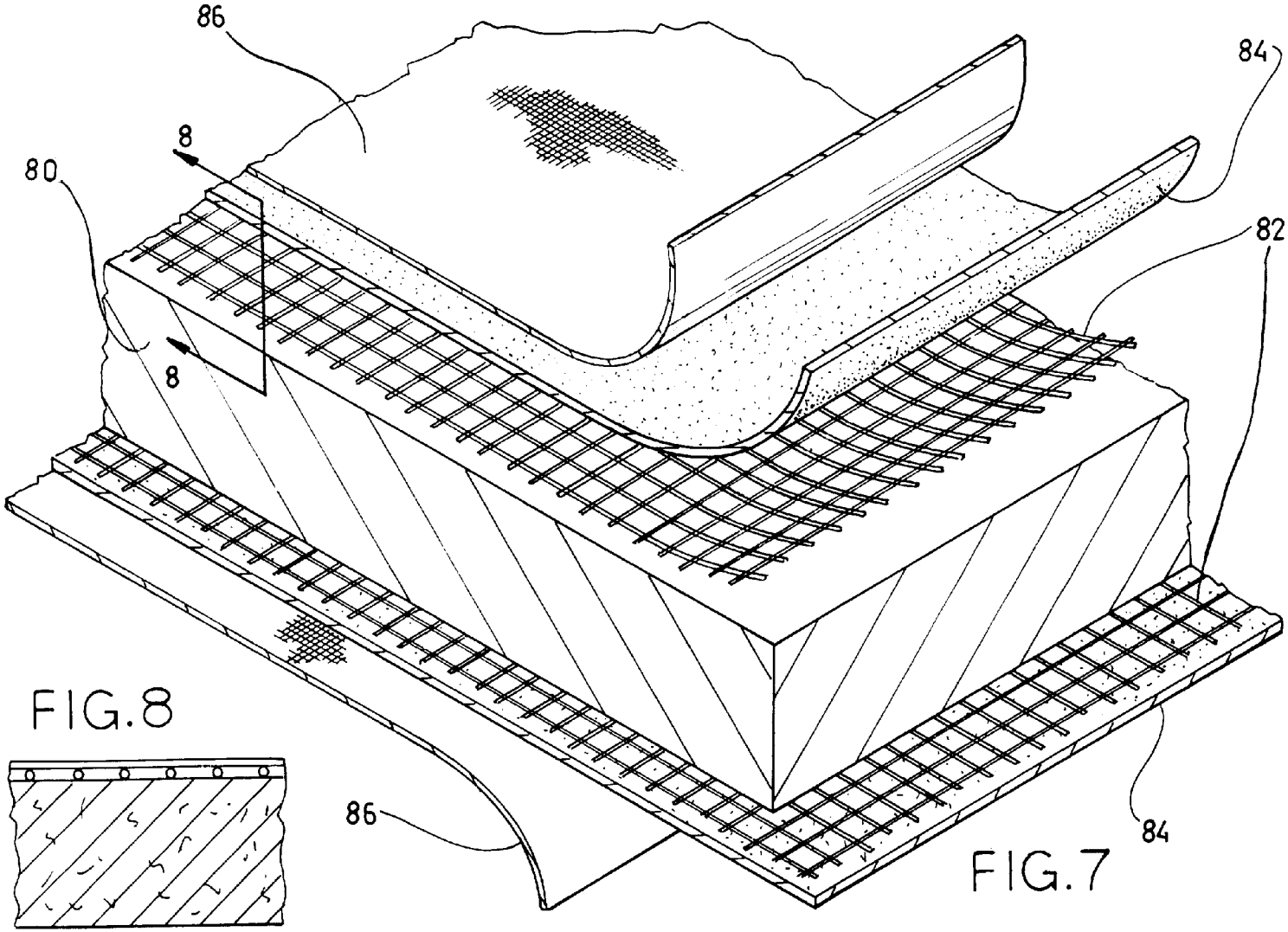
FIG. 7 is a perspective cutaway and partly exploded view of a piece of padding illustrating the invention.
FIG. 8 is a section of a modified padding material showing the scrim material actually embedded in the surface layer of the pad.

Referring now to FIG. 7 the construction of the individual pads is illustrated in more detail. Each pad according to the invention, comprises a central pad portion 80 of polypropylene foam material having the desired density. On each side there is bonded a reinforcing layer of scrim material 82—82. One form of such scrim material is well known and is widely used in the glass fibre art. It is formed of glass fibre threads or filaments. In some cases the filaments are woven together at right angles which increases their strength. The scrim material provides reinforcement to the exterior of the foam. This allows the foam to flex and bend without cracking. The scrim also has the effect of receiving the impact or blow during play and spreading the shock over a wider area of the foam pad.

As mentioned above however the scrim material is not restricted solely to glass fibre threads, but may be made of a wide variety of different materials such as, for example fibre glass strands, aramid fibres, polyester fibres, polyethylene fibres, carbon fibres, or even flexible metallic fibres, to name only a few suitable scrim reinforcement materials.

The strength of the foam pad is further increased by the inner and outer closure panels 24–26, or 60–62, which are bonded to the scrim material. As shown in FIG. 7 each inner and outer panel comprises an inner thin layer of polyurethane foam material 84, and an outer layer of woven fabric 86, typically being a synthetic material such as polyester fibre or the like. The inner and outer layers and adhesively bonded together to form a laminate panel, for bonding to the scrim material. These inner and outer closure panels further help to lend flexibility to the foam padding and at the same help absorb and spread the shock of a blow or an impact.

Such composite padding can readily be formed in a single molding operation, so that a mold shaped to provide the particular pad shape required for the position in the garment, and for the size of the garment, can be used to both mold the polypropylene foam and at the same time bond the scrim layers and the inner and outer panels together all in a single operation.

Figure 9:
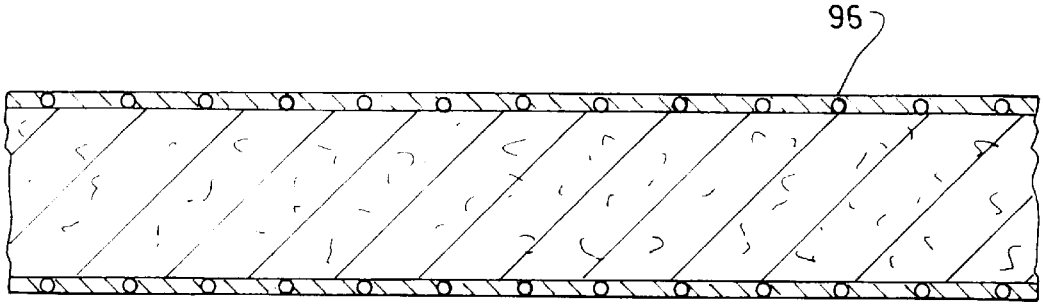
FIG. 9 is a section of a pad formed with a skin and having the scrim embedded in the skin.

Bonding of the scrim layers into the padding may be achieved by initially applying heat at a temperature sufficient to expanded the plastic beads and fill the mold. Thereafter heat on the exterior of the mold may be increased so as to fuse the beads at the surface of the pad into a skin like surface layer of greater strength, as shown in FIG. 9. In doing so the scrim material will become embedded in the fused skin and will add still greater reinforcement to the pad.

Figure 10:
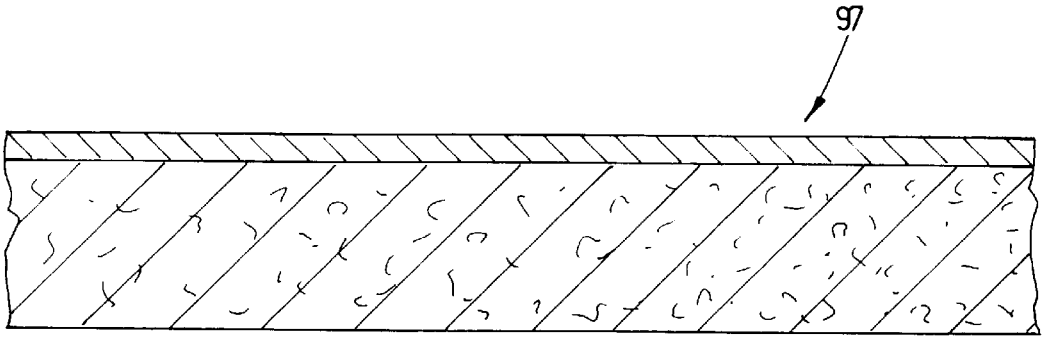
FIG. 10 is a section of a composite pad formed as a single molding, of two plastics of two different properties, or densities.

Moulding of two layers of padding of two different densities may also be achieved in a single moulding operation, to produce a single fused pad shaped as desired and comprising two different densities of foam, as shown in FIG. 10.

Figure 11:
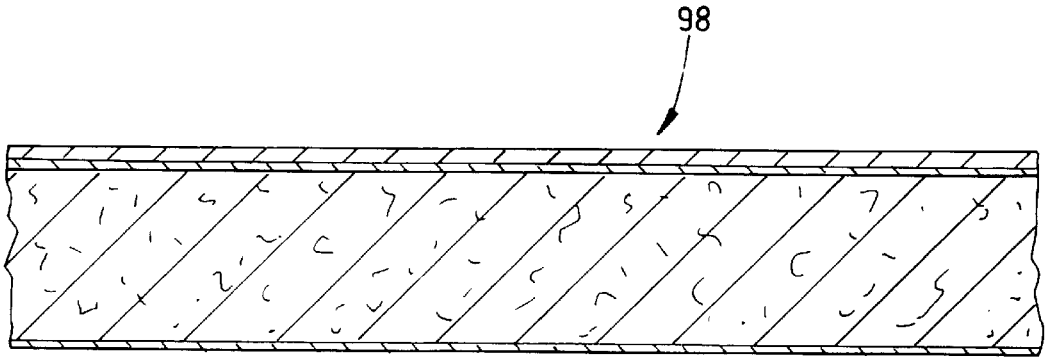
FIG. 11 is a section of a composite pad formed in a single molding operation with the fabric layer and the pad molded together, thus avoiding the adhesive bonding step.
Figure 12:
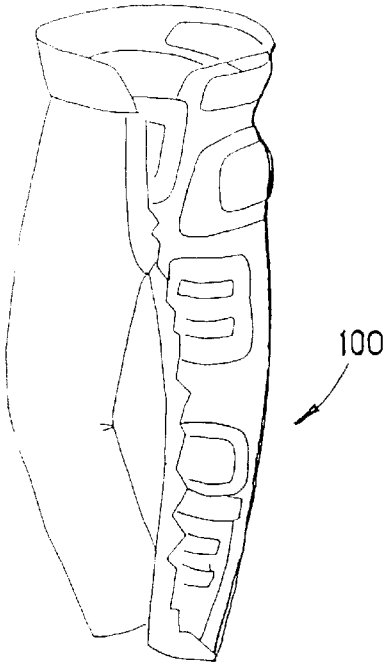
FIGS. 12, 13, 14, 15, 16 and 17 are schematic views illustrating various different forms of padded garments for protecting the body in various types of athletics, in all of which the invention finds useful unique advantages.
Figure 13:
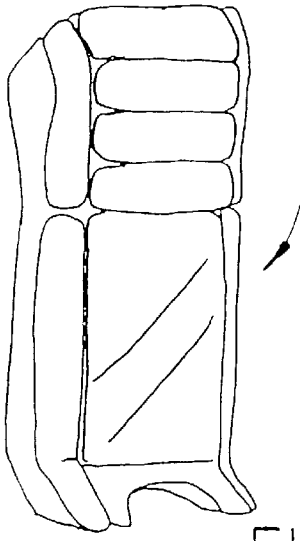
Figure 15:
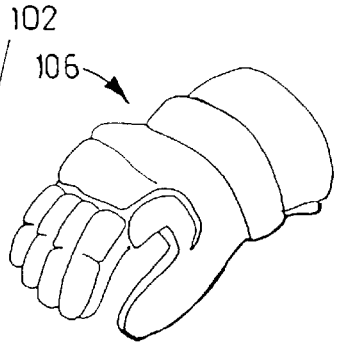
Figure 14:
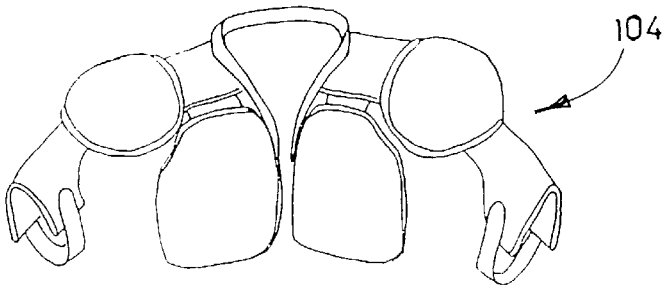
Figure 16:
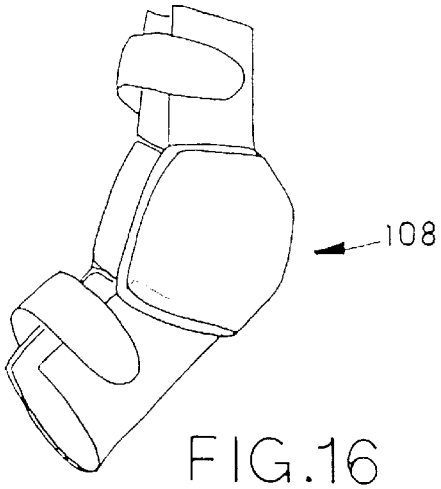
Figure 17:
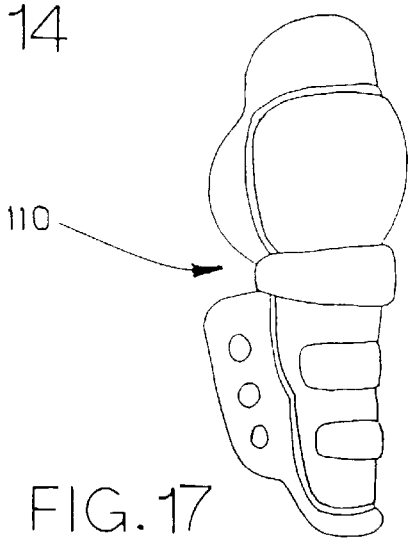

The same one step moulding operation may also enable the application of the inner and outer fabric layers, with or without the additional polyurethane foam layer, to produce a composite pad as shown in FIG. 11.

Polypropylene bead material particularly, although not exclusively suited to the invention, is a material made under the name "NEOPOLEN" trade mark of BASF. This material can be obtained having a wide range of properties and resistant to a wide range of materials and environmental conditions, making it particularly suitable.

As mentioned above the invention is not confined solely to the fabrication of padded pants, but has application to a wide range of body padding items, whether considered strictly as a garment in the narrow sense, or in the broader sense as anything that can be attached to the body as protection. Referring to FIGS. 12, 13, 14, 15, 16, and 17, there are illustrated, in order, a pair of full length padded trousers 100 such as may be worn by goalkeepers in hockey, a shin pad 102, being one of a pair, such may be worn in hockey, baseball or cricket, for example, a set of shoulder and chest pads 104 such as may be worn in hockey or football or baseball with appropriate variations, a pair of padded gloves 106 such as may be worn in hockey, cricket or the like, a pair of elbow pads 108 such as may be worn in hockey, or skateboarding, rollerblading or the like, and a set of knee and leg pads 110, such as may be worn in hockey skateboarding, rollerblading or the like.

In all of these examples, and there are many others that could be shown, the padding system of the invention can be used with great advantage, making the article perform in a superior manner for absorbing and protecting the body from blows and sharp impacts, and at the same.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. An athletic body pad construction, for a padding garment comprising:

a body shape moulded pad member formed of expanded polypropylene foam material, of a predetermined density, and moulded and shaped to conform to a portion of the body to be protected, defining inner and outer sides;

an inner reinforcement of scrim filaments bonded with the inner side of said pad member in a single moulding operation whereby said scrim filaments are embedded in an outer fused skin of said pad member and shaped to the inner side of said pad member;

an outer reinforcement of scrim filaments bonded with the outer side of said pad member in a single moulding operation whereby said scrim filaments are embedded in an outer fused skin of said pad member and shaped to the outer side of said pad member;

an inner covering panel of synthetic woven fabric with edges of said inner covering panel extending beyond edges of said pad member;

an inner polyurethane foam layer located between said inner covering panel and said pad member with edges of said inner polyurethane foam layer extending beyond edges of said pad member;

an outer covering panel of synthetic woven fabric with edges of said outer covering panel extending beyond edges of said pad member;

an outer polyurethane foam layer located between said outer covering panel and said pad member with edges of said outer polyurethane foam layer extending beyond the edges of said pad member;

means bonding said inner polyurethane layer to said inner side of said pad member;

means bonding said inner covering panel to said inner polyurethane layer;

means bonding said outer polyurethane layer to said outer side of said pad member;

means bonding said outer covering panel to said outer polyurethane layer;

means bonding said edges of said inner and outer covering panels and said edges of said inner and outer polyurethane layers together, around the edges of said pad member, whereby to provide marginal portions there around, for construction into a complete body pad system; and body attachment means secured to said marginal portions.

2. An athletic body pad construction as claimed in claim 1 wherein said polypropylene foam material comprises a first inner light weight layer of low density polypropylene foam, and at least one outer higher density harder layer of polypropylene foam bonded to said inner layer thereby providing for a multiple layer pad of impact absorption material of varying density.

3. An athletic body pad construction as claimed in claim 1 wherein said body pad is flexible so that it will readily conform to the body as the padding garment is put on and tightened up on the body, whereby the wearer will experience the least possible interference with athletic abilities.

4. An athletic body pad construction as claimed in claim 1 wherein said body pad is moulded into a predetermined shape, formed with the optimum size, shape and thickness and contour desired whereby there is a minimum of material waste.

5. An athletic body pad construction as claimed in claim 1 including a loose outer layer of fabric forming a garment, said pad member being supported within said loose outer layer of fabric.

6. An athletic body pad construction as claimed in claim 2 wherein said first inner light weight layer of low density polypropylene foam and said at least one outer higher density harder layer of polypropylene foam are formed together in a single moulding operation.

7. An athletic body pad construction as claimed in claim 1 wherein said scrim filaments comprise a layer of woven filaments intersecting one another at right angles.

8. An athletic body pad construction as claimed in claim 4 wherein said pad member is formed with an outer integral skin of the same material as said pad member, said outer integral skin comprising foam pad material which is subjected to heat and pressure to melt said foam pad material and form a skin.

9. An athletic body pad as claimed in claim 1 wherein the padding garment is a pair of full length trousers for protecting the legs.

10. An athletic body pad as claimed in claim 1 wherein the padding garment is a pair of shin pads for hockey goal players.

11. An athletic body pad as claimed in claim 1 wherein the padding garment is set of combined shoulder and chest pads.

12. An athletic body pad as claimed in claim 1 wherein the padding garment is a pair of hockey gloves.

13. An athletic body pad as claimed in claim 1 wherein the padding garment is a pair of elbow pads.

14. An athletic body pad as claimed in claim 1 wherein the padding garment is a pair of shin pads for playing games such as hockey.

15. An athletic body pad construction, for a padding garment, said pad construction comprising:

a body shape moulded pad member formed of expanded polypropylene foam material, said pad member in turn comprising:

a first inner light weight layer of low density polypropylene foam, and, at least one outer higher density harder layer of polypropylene foam bonded to said inner layer whereby said pad member provides for a multiple layer pad of impact absorption material of varying density, and wherein said pad member is moulded into a predetermined shape, formed with the optimum size, shape and thickness and contour desired whereby there is a minimum of material waste, said pad member defining inner and outer sides;

a loose outer layer of fabric forming a garment and enclosing and supporting said pad member;

an inner reinforcement of scrim filaments bonded with the inner side of said pad member in a single moulding operation whereby said scrim filaments are embedded in an outer fused skin of said pad member and shaped to the inner side of said pad member;

an outer reinforcement of scrim filaments bonded with the outer side of said pad member in a single moulding operation whereby said scrim filaments are embedded in an outer fused skin of said pad member and shaped to the outer side of said pad member;

an inner covering panel of synthetic woven fabric with edges of said inner covering panel extending beyond edges of said pad member;

an inner polyurethane foam layer located between said inner covering panel and said pad member with edges of said inner polyurethane foam layer extending beyond edges of said pad member;

an outer covering panel of synthetic woven fabric with edges of said outer covering panel extending beyond edges of said pad member;

an outer polyurethane foam layer located between said outer covering panel and said pad member with edges of said outer polyurethane foam layer extending beyond the edges of said pad member;

means bonding said inner polyurethane layer to said inner side of said pad member;

means bonding said inner covering panel to said inner polyurethane layer;

means bonding said outer polyurethane layer to said outer side of said pad member;

means bonding said outer covering panel to said outer polyurethane layer;

means bonding said edges of said inner and outer covering panels and said edges of said inner and outer polyurethane layers together, around the edges of said pad member, whereby to provide marginal portions there around, for construction into a complete body pad system; and body attachment means secured to said marginal portions.

* * * * *